US005542749A

United States Patent [19]

Toth

[11] Patent Number: 5,542,749

[45] Date of Patent: Aug. 6, 1996

[54] METHOD AND APPARATUS FOR GATHERING AND FORMING A TUFT OF BRUSH BRISTLES

[75] Inventor: Mike Toth, St. Charles, Ill.

[73] Assignee: Carlson Tool & Machine Co., Geneva, Ill.

[21] Appl. No.: 371,351

[22] Filed: Jan. 11, 1995

[51] Int. Cl.[6] ..... A46D 1/08

[52] U.S. Cl. ..... 300/4; 300/5; 300/7

[58] Field of Search ..... 300/2–11, 21

[56] References Cited

U.S. PATENT DOCUMENTS

| | | |
|---|---|---|
| 1,359,165 | 11/1920 | Gladwin et al. . |
| 1,424,545 | 8/1922 | Yeager et al. . |
| 1,426,382 | 8/1922 | Henning et al. . |
| 1,664,420 | 4/1928 | Jobst et al. . |
| 1,936,743 | 11/1933 | Zahoransky et al. . |
| 2,324,480 | 7/1943 | Carlson et al. . |
| 2,324,481 | 7/1943 | Carlson et al. . |
| 2,324,482 | 7/1943 | Carlson et al. . |
| 2,415,083 | 2/1947 | Carlson et al. . |
| 3,065,469 | 11/1962 | Parker et al. . |
| 3,704,915 | 12/1972 | Schofield . |

FOREIGN PATENT DOCUMENTS

| | | | |
|---|---|---|---|
| 1100589 | 3/1961 | Germany | 300/5 |

*Primary Examiner*—Mark Rosenbaum

*Attorney, Agent, or Firm*—McAndrews, Held & Malloy, Ltd.

[57] ABSTRACT

A method and apparatus for gathering a plurality of brush bristles into a bundle and forming the bristle bundle into a tuft. The apparatus comprises a housing and a centerpiece. The housing comprises a first end, a second end, a longitudinal axis extending from the first end to the second end, a bore formed in the interior of the housing and extending generally along the housing longitudinal axis, and a slot formed in the exterior of the housing. The housing slot communicates with the housing exterior and extends generally diagonally toward the housing second end from the housing exterior to the housing interior such that the housing slot communicates with the housing bore. The centerpiece is adapted to be slidably received within the housing bore and comprises a first end, a second end, a longitudinal axis extending from the first end to the second end, and a slot formed in the exterior of the centerpiece. The centerpiece slot communicates with the centerpiece exterior and intersects the centerpiece longitudinal axis. The centerpiece slot extends generally diagonally opposite the housing slot from the centerpiece exterior to the centerpiece longitudinal axis. When the centerpiece is displaced within the housing bore toward the housing second end, the centerpiece gathers a plurality of brush bristles into a bundle within a convergence of the housing slot and the centerpiece slot, and transports the bristle bundle within the convergence along the slots from the housing exterior to the centerpiece longitudinal axis.

7 Claims, 7 Drawing Sheets

68

3d
3c
62
E'
E
101
102
110
66
108
182
100
76
F
F'
106
182
112
104
68
74
74
70
72
182
60
60'
60"
98'
98"
182
64
3d
3c 77
79
76"
77
STOCK
FEED
3f
3e
3e
78"
68"
74
180"
184
60"
98'
184

100
76'
77
77
79
106
STOCK
FEED
3f
3f
78'
68'
74
180'
186
184
60'
184
98'
186

METHOD AND APPARATUS FOR GATHERING AND FORMING A TUFT OF BRUSH BRISTLES

FIELD OF THE INVENTION

The present invention relates generally to methods and apparatus for the manufacture of brushes and the like, and more particularly to an improved method and apparatus for gathering a bundle of brush bristles, forming the bundle into a tuft, and anchoring the tuft to a brush block workpiece.

BACKGROUND OF THE INVENTION

The use of mechanical apparatus for gathering a bundle of brush bristles and forming a tuft is well known in the brush making art. For example, U.S. Pat. No. 1,512,588 shows a conventional brush bristle gathering and tuft forming head, known in the art as a "filling tool." Filling tools typically are adapted as components of machines for the complete manufacture of entire brush assemblies, such as the conventional "drill and fill" machines of the type shown in U.S. Pat. Nos. 2,324,480 and 3,704,915.

The conventional brush bristle gathering, tuft forming, and tuft inserting ("filling") operation includes the separate steps of (1) gathering ("picking off") a plurality of brush bristles (a bundle) from a stock box or magazine and delivering the bundle to the tuft forming area, (2) forming and positioning a fastener such as a wire staple or the like at the central portion ("mid-point") of the bundle, (3) forming a "tuft" of bristles by bending or "breaking" the bundle at its mid-point, and (4) driving the fastener and broken portion or "bight" of the bundle into a brush block workpiece whereby the fastener anchors the resulting bight portion of the bundle to the block with the two end portions or legs of the bundle extending outwardly to provide the bristle tuft.

In the conventional brush filling tool apparatus, several separate sub-assemblies are necessary to perform the steps of the conventional brush filling method. For example, one sub-assembly (a "picker bar") gathers the bristle bundle from a stock box or magazine and transports the bundle to the tuft forming area. Conventional picker bars are illustrated in FIGS. 10 and 11. Another sub-assembly forms a fastener and an additional subassembly positions the fastener around the mid-point of the bundle. A further sub-assembly forms the tuft by breaking the bundle at its mid-point and yet another sub-assembly anchors the fastener/tuft combination to the brush block workpiece.

Each of the filling tool sub-assemblies requires a complicated precision drive mechanism necessary to cause the brush filling tool apparatus to operate in a synchronous manner to form and anchor a multiplicity of brush tufts to brush block workpieces at a high production rate on the order of several hundred cycles per minute. In particular, the picker bar sub-assembly includes a complicated precision drive mechanism necessary to cause the picker bar to operate in a synchronous manner with the filling tool. In addition, the sub-assemblies for forming and positioning the fastener at the mid-point of the bristle bundle also include complicated precision drive mechanisms. The interaction timing between these separate drive mechanisms is critical and requires constant monitoring and adjustment. Thus these complicated mechanisms and filling tool sub-assemblies are difficult to maintain due to their multiplicity of moving parts, are prone to mechanical wear and vibration, and fail frequently resulting in costly down-time for the brush manufacturing machinery.

In addition, each sub-assembly corresponds to a separate step necessary in the conventional brush filling method. During execution of the conventional filling operation, each filling tool sub-assembly advances while performing its separate step and then reciprocates in relation to the other sub-assemblies which remain stationary or counter-reciprocate. Thus, the operation each subassembly of the filling tool requires a discrete time period in the complete filling tool operation cycle. The necessity of these discrete time periods extends the time required for one complete filling cycle and contributes to the inefficiency of the conventional brush tuft gathering and forming method.

SUMMARY OF THE INVENTION

Accordingly, one feature of the present invention is to provide an improved brush bristle gathering and tuft forming apparatus which includes fewer and less complicated sub-assemblies for gathering a bundle and forming a tuft of brush bristles.

Another feature of the present invention is to eliminate the separate sub-assembly required to gather a bundle of brush bristles from a stock box or magazine and transport the bundle to the tuft forming area of the filling tool.

An additional feature is to eliminate the separate complicated precision drive mechanisms necessary to cause the sub-assemblies of the conventional brush bristle gathering and tuft forming apparatus to operate in a synchronous manner.

Yet another feature is to improve the sub-assembly for forming and positioning the fastener at the mid-point of the bundle by eliminating the complicated precision drive mechanism necessary to cause a conventional wire staple fastener forming and positioning apparatus to operate in a synchronous manner with the filling tool.

A related feature of the present invention is to improve the method of gathering a bundle of brush bristles and forming a tuft by utilizing fewer separate steps than the conventional brush bundle gathering and tuft forming method.

Yet another feature is to simultaneously perform the continuous integrated steps of gathering a bundle of brush bristles from a stock box or magazine and transporting the bundle to the tuft forming area, forming and positioning a fastener around the bristles, forming the tuft, and anchoring the fastener/tuft combination to the brush block workpiece.

These and other features and advantages are accomplished by the present invention which is adapted for use with conventional brush making machinery, and are provided in an improved method and apparatus for gathering a bundle of brush bristles, forming a tuft, and anchoring the tuft to a brush block workpiece. Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

According to the present invention the foregoing and other objects and advantages are attained by an apparatus for gathering a plurality of brush bristles into a bundle and forming the bristle bundle into a tuft which comprises a housing and a centerpiece. The housing comprises a first end, a second end, a longitudinal axis extending from the first end to the second end, a bore formed in the interior of the housing and extending generally along the housing longitudinal axis, and a slot formed in the exterior of the housing. The slot has a proximal end and a distal end. The housing slot communicates with the housing exterior and extends generally diagonally toward the housing second end into the housing interior such that the housing slot communicates with the housing bore. The centerpiece is adapted to be slidably received within the housing bore and comprises a first end, a second end, a longitudinal axis extending from the first end to the second end, and a slot formed in the exterior of the centerpiece. The centerpiece slot is in communication with the centerpiece exterior and has a proximal end and a distal end that intersects the centerpiece longitudinal axis. The centerpiece slot extends generally diagonally away from the centerpiece second end toward the centerpiece longitudinal axis. When the centerpiece is displaced within the housing bore from the housing first end toward the housing second end, the centerpiece gathers a plurality of brush bristles disposed at the housing slot proximal end into a bundle within a convergence of the housing slot and the centerpiece slot, and transports the bristle bundle within the convergence along the slots from the housing exterior to the centerpiece longitudinal axis.

According to another aspect of the present invention the apparatus comprises a driving member adapted to slide within the centerpiece bore. The driving member has a first end, a second end, and a longitudinal axis extending from the first end to the second end. Displacing the driving member within the centerpiece bore from the centerpiece first end toward the centerpiece second end causes the driving member second end to engage the bristle bundle gathered within the convergence of the housing slot and the centerpiece slot, to fold the bristle bundle at its midpoint to form a tuft of bristles in the centerpiece bore, to transport the tuft through the centerpiece bore to the centerpiece second end, and to anchor the tuft to an adjacent brush block workpiece.

According to a further aspect of the present invention the apparatus comprises a fastener forming tool which has a proximal end adapted to pivot about a fixed point and a distal end having a fastener forming mandrel adapted to be inserted into an opening in the centerpiece so that the mandrel is positioned at a fastener forming area within the centerpiece bore. The tool has a cam surface which operatively engages a mating surface on the centerpiece. Displacing the centerpiece from the forming tool proximal end toward the tool distal end causes the cam surface and the mating surface to slide and engage so that the tool pivots about the fixed point and the mandrel is withdrawn from the centerpiece opening. The tool also has a spring or the like for positively urging the cam surface against the mating surface. Displacing the centerpiece from the tool distal end toward the tool proximal end causes the cam surface and the mating surface to slide so that the tool pivots about the fixed point and the mandrel is inserted into the centerpiece opening.

According to the present invention the foregoing and other objects and advantages are attained by a method for simultaneously gathering a plurality of brush bristles and forming the bristles into a tuft which comprises the continuous integrated steps of gathering a bundle of brush bristles from a stock box or magazine and transporting the bundle to the tuft forming area utilizing the tuft forming apparatus.

These and other features and advantages are apparent from the following detailed description.

BRIEF DESCRIPTION OF THE DRAWINGS

A preferred embodiment of the present invention is described herein with reference to the drawings wherein:

FIG. 2 is a cross-sectional view of the gathering and forming apparatus of FIG. 1.

DETAILED DESCRIPTION OF THE PREFERRED EMBODIMENT

Figure 1:
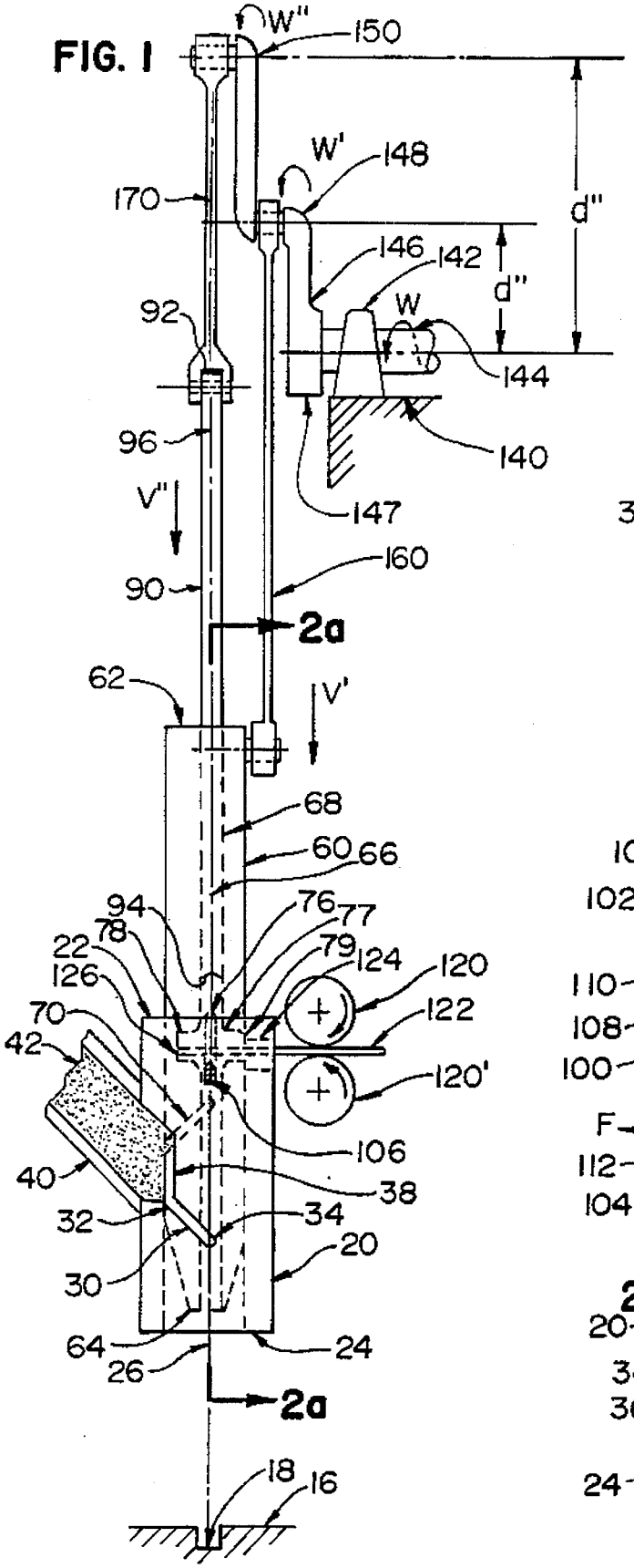
FIG. 1 is a side elevation view of an apparatus for gathering a bundle of brush bristles, forming the bundle into a tuft, and anchoring the tuft to a brush block workpiece according to the present invention.
Figure 2B:
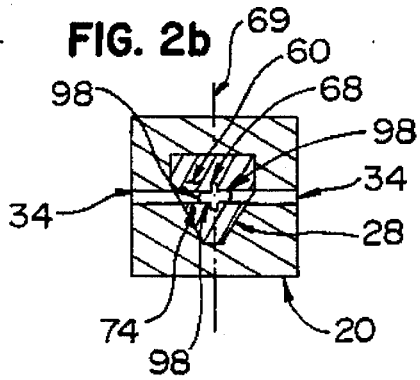
FIG. 2*b* is a top cross-sectional plan view of the taken along line b—b of FIG. 2*a*.
Figure 2A:
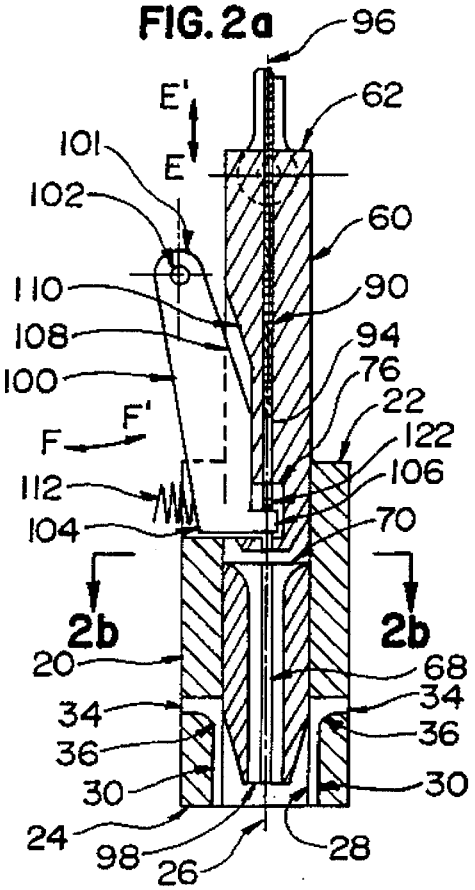
FIG. 2*a* is a side elevation cross-sectional view taken along line 2*a*—2*a* of FIG. 1 partially cut away to show the interior of the apparatus and also showing a fastener forming tool according to the present invention.
Figures 3A, 3B, 3C, 3D, 3E, 3F:
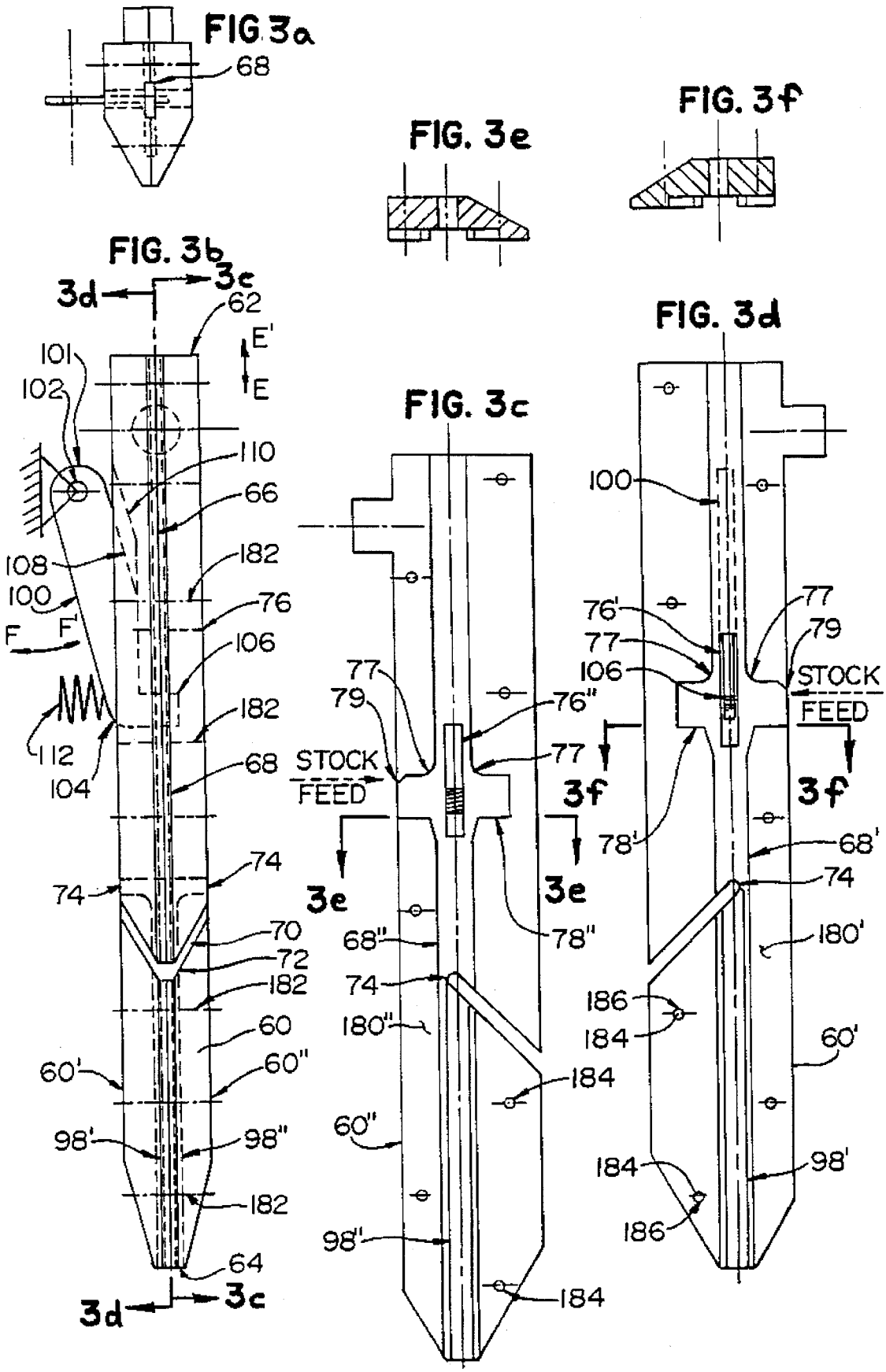
FIG. 3 is a detailed enlargement of a preferred embodiment of the centerpiece which includes cross-sectional elevations and plan views.

Referring to FIG. 1, in accordance with the present invention an improved brush filling tool is shown which comprises a housing 20, a centerpiece 60, a driving member 90, a drive mechanism 140, and a fastener stock feeding device 120/120'. An additional detail with respect to the invention is shown in FIGS. 2*a* & 3, wherein a fastener forming tool 100 is shown. In the illustrated embodiment of the invention shown in FIG. 1 the brush filling tool apparatus is oriented vertically and positioned over a brush block workpiece 16 having a hole 18 adapted to receive a tuft of brush bristles gathered and formed by the filling tool. Those skilled in the art will appreciate that other orientations may be suitable for operation of the apparatus according to the present invention, and that the apparatus of the invention may be adapted to other suitable workpiece arrangements and configurations, for example, non-flat workpieces or workpieces without holes for receiving the tuft.

Referring again to FIG. 1, the housing 20 has a first end 22, a second end 24, and a longitudinal axis 26 extending generally from the first end 22 to the second end 24 of the housing 20. A bore 28 is formed in the interior of the housing 20 and extends generally along the longitudinal axis 26. The housing bore 28 can be seen in cross-section in FIG. 2*b*. In this embodiment of the present invention, the housing longitudinal axis 26 and housing bore 28 extend generally along the vertical centerline of the housing 20, but those skilled in the art will appreciate that the housing bore 28 may be located at other suitable locations within the interior of the housing 20.

A slot 30 is formed in the exterior of the housing 20 that has a proximal end 32 and a distal end 34. The housing slot 30 opens into the housing bore 28 all along the length of the housing slot 30. The housing slot 30 extends generally diagonally from the slot proximal end 32 at the housing exterior toward the housing second end 24. In the vertically oriented embodiment shown in FIG. 1, the housing slot 30 extends generally diagonally downward. In the illustrated embodiment the housing slot 30 is shown in cross-section in FIG. 2*a*, which shows that the housing slot 30 is formed horizontally in the cross-section of the housing 20 and is formed between the housing exterior and the housing bore 28. The proximal end 34 and interior edges 36 of the housing slot 30 are rounded. In the vertically oriented embodiment illustrated, the housing slot 30 is shown in side elevation view and extends through the entire cross-section of the housing 20 so that a mirror image of the slot opens in the opposite side of the housing exterior (not shown), forming a continuous opening through the housing 20 from the side elevation shown to the opposite side (not shown).

Referring again to FIG. 1, an opening 38 is formed in the exterior of the housing 20 that communicates with the housing bore 28 and which is located at the proximal end 32 of the housing slot 30. A stock box 40 is positioned at the exterior of the housing 20 and located adjacent to the opening 38. The stock box 40, also known as a magazine, may be any type of receptacle or device known to those skilled in the art suitable to contain a plurality of brush bristles 42 such that the bristles 42 are disposed adjacent to the proximal end 32 of housing slot 30. In the vertically oriented embodiment of FIG. 1, the bristles 42 are viewed from the bristle ends with the length of the bristles 42 oriented horizontally and generally perpendicular with respect to the vertical housing longitudinal axis 26. In the illustrated embodiment, the bristles 42 are urged into the housing opening 38 by gravity caused by the downward diagonal slope of the stock box 40. Those skilled in the art will appreciate that other suitable methods may be employed to urge the bristles 42 against the opening 38, such as a spring-driven or pneumatic bristle feeding device. Likewise, other suitable orientations for the bristles 42 may be employed depending upon the orientation of the housing longitudinal axis 26.

Referring to FIG. 3, in accordance with the invention a centerpiece 60 is adapted to slide within the housing bore 28 (see FIG. 2*b* and FIGS. 4–6; explained below). A cross-sectional plan view of the centerpiece 60 within the housing bore 28 is shown in FIG. 2*b*. The exterior dimensions and outline of the centerpiece 60 are generally the same as the dimensions and outline of the housing bore 28. The machine tolerances and fit between the exterior of the centerpiece 60 and the housing bore 28 will be known to those skilled in the art as would be required to allow the centerpiece 60 to reciprocate within the housing bore 28 at a rate of up to 500 cycles per minute. In the embodiment shown in FIGS. 2*b* & 3, the cross-sectional outline of the centerpiece 60 is shown as a pentagonal trapezoid, however other cross-sections such as diamond-shaped, rectangular, or round may be equally suitable to practice the present invention.

The centerpiece 60 has a first end 62 and a second end 64, and a longitudinal axis 66 extending generally from the first end 62 to the second end 64 of the centerpiece 60. A bore 68 is formed in the interior of the centerpiece 60 and extends generally along the longitudinal axis 66. The centerpiece bore 68 can be seen in elevation cross-section in FIG. 2*a* and in cross-sectional plan view in FIG. 2*b*. In the illustrated embodiment of the present invention, the longitudinal axis 66 and centerpiece bore 68 extend generally along the vertical centerline of the centerpiece 60, but those skilled in the art will appreciate that the centerpiece bore 68 may be located at other suitable locations within the interior of the centerpiece 60. In the preferred embodiment illustrated herein, the second end 64 of the centerpiece 60 is shown in a tapered configuration. Those skilled in the art will appreciate that many different configurations of the centerpiece second end 64 may be used to practice the present invention, depending upon the many parameters particular to various brush filling operations, such as the type and size of the bristles 42, the orientation, size, and shape of the brush block workpieces 16, the spacing of the holes 18 (if any), and the like.

Referring to FIG. 3, an enlarged cross-sectional detail of the centerpiece 60 is shown. In accordance with the invention, a slot 70 is formed in the exterior of the centerpiece 60 that opens in the centerpiece exterior all along its length and which has a proximal end 72 and a distal end 74 that intersects the centerpiece longitudinal axis 66. The centerpiece slot 70 extends generally diagonally away from the centerpiece second end 64 from the centerpiece exterior to the centerpiece longitudinal axis 66. Grooves 98' and 98" are formed in the interior of the centerpiece 60 that extend parallel to the centerpiece longitudinal axis 66 in communication with the centerpiece bore 68 from the distal end 74 of the centerpiece slot 70 to the centerpiece second end 64 forming in plan view an approximate "cross" shape with the grooves 98' and 98" generally perpendicular with respect to the centerpiece bore 68 and generally parallel with respect to the convergence of housing slot distal end 34 and centerpiece slot distal end 74. In the vertically oriented embodiment illustrated, the centerpiece slot 70 is shown in side elevation view and extends through the entire cross-section of the centerpiece 60 so that a mirror image of the slot opens in the opposite side of the centerpiece exterior (not shown), forming a continuous opening through the centerpiece 60 from the side elevation shown to the opposite side (not shown).

Referring again to FIG. 3, additional details of the preferred embodiment of the centerpiece 60 are shown. The centerpiece 60 comprises two mating pieces 60' and 60" which have complimentary mating faces 180' and 180", respectively. A centerpiece bore half 68' and 68" and a groove 98' and 98" are formed in the mating faces 180' and 180", respectively. A plurality of boltholes 182 is formed in the mating pieces 60' and 60" adapted to receive a plurality of machine screws 184 to hold the mating pieces 60' and 60" together at the mating faces thereby forming the centerpiece 60. The boltholes 182 extend from the exterior of each mating piece 60' and 60" to the respective mating faces 180' and 180". The boltholes 182 are counter-sunk bored at the exterior surfaces of the mating pieces 60' and 60" so that the heads 186 of the machine screws 184 are received within the boltholes 182 and do not project beyond the surface of the centerpiece 60. The boltholes 182 are tapped to receive the threads of the machine screws 184. In the illustrated embodiment, the centerpiece 60 is shown comprised of mirror-image mating pieces 60' and 60" to facilitate fabrication of the centerpiece 60. Those skilled in the art will appreciate that many other configurations of mating pieces and machine screws may be adapted to facilitate fabrication of the centerpiece 60 and practice the present invention.

Figure 4:
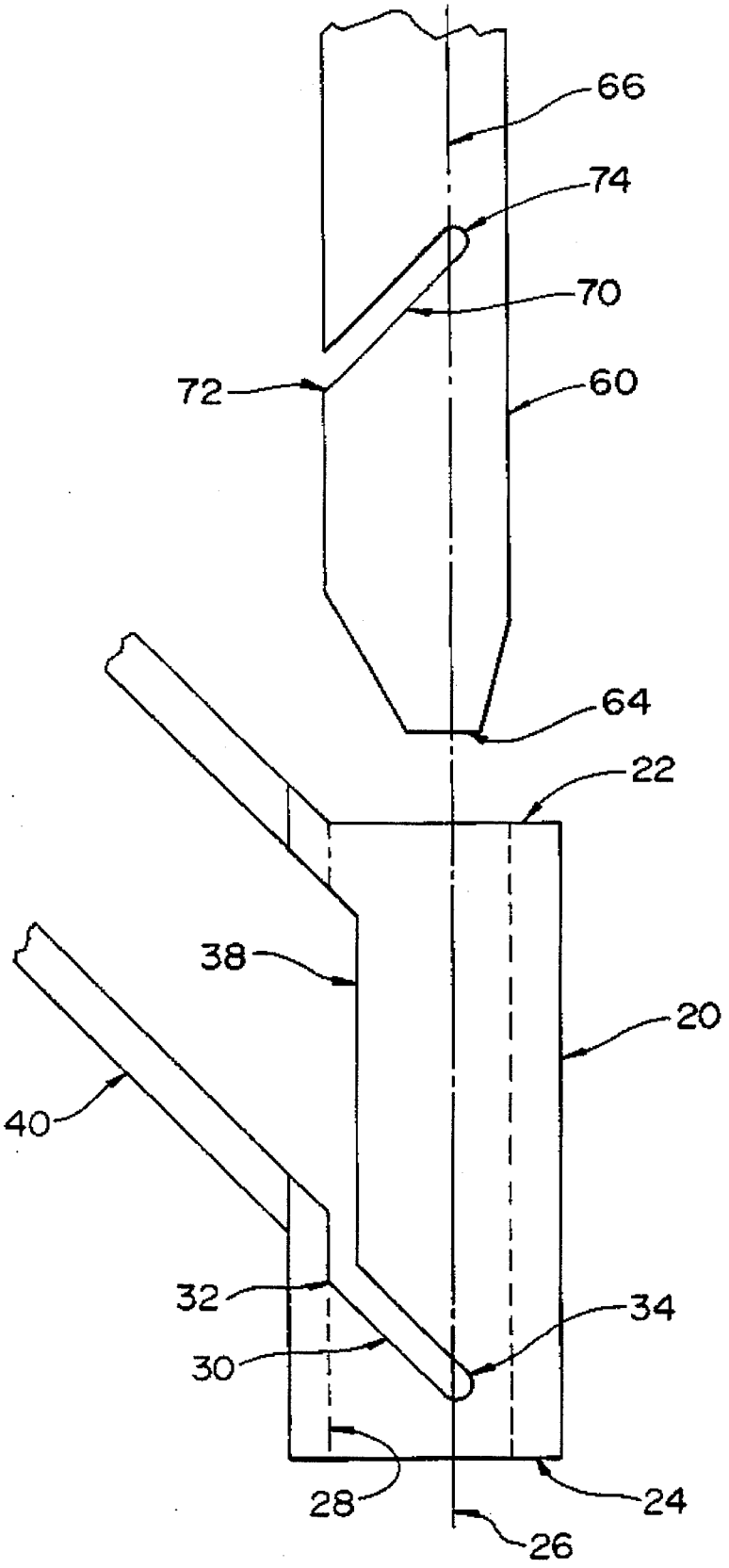
FIGS. 4–6 are enlarged side elevation views of the housing and centerpiece of the gathering and forming apparatus showing the sequence of operation of the housing and centerpiece according to the present invention.

FIG. 4 shows an enlarged elevation view of the housing 20 and centerpiece 60 according to the invention. For clarity and illustration, the centerpiece 60 is shown withdrawn from the housing bore 28 and the centerpiece bore 68 is not shown in FIG. 4. In the preferred embodiment, the centerpiece longitudinal axis 66 coincides with the housing longitudinal axis 26. In the vertically oriented embodiment shown in FIG. 4, the centerpiece slot 70 extends generally diagonally upward and opposite the generally downward diagonal housing slot 30. The centerpiece slot 70 also is shown in phantom in FIG. 1.

Figure 5:
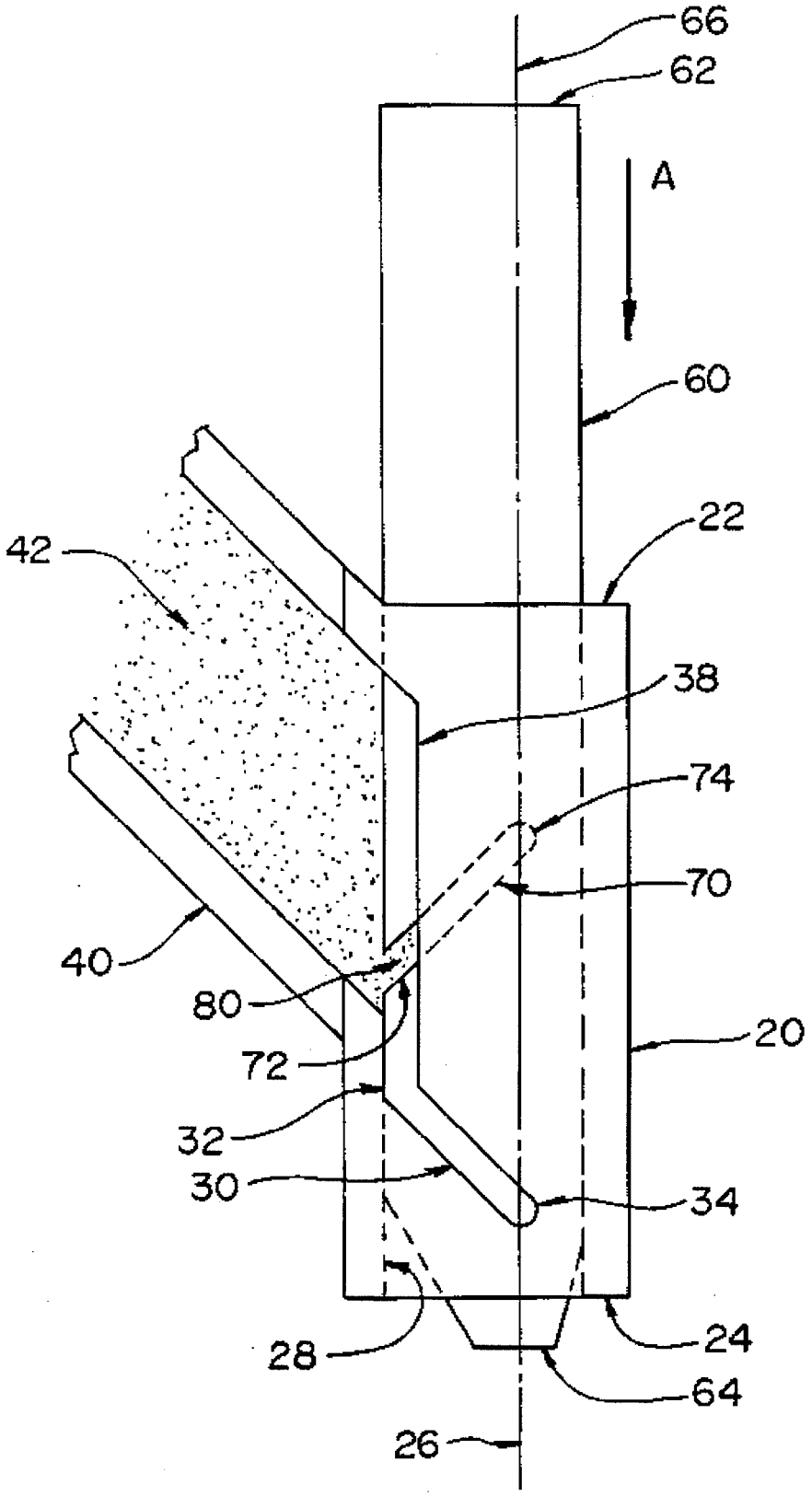
Figure 6:
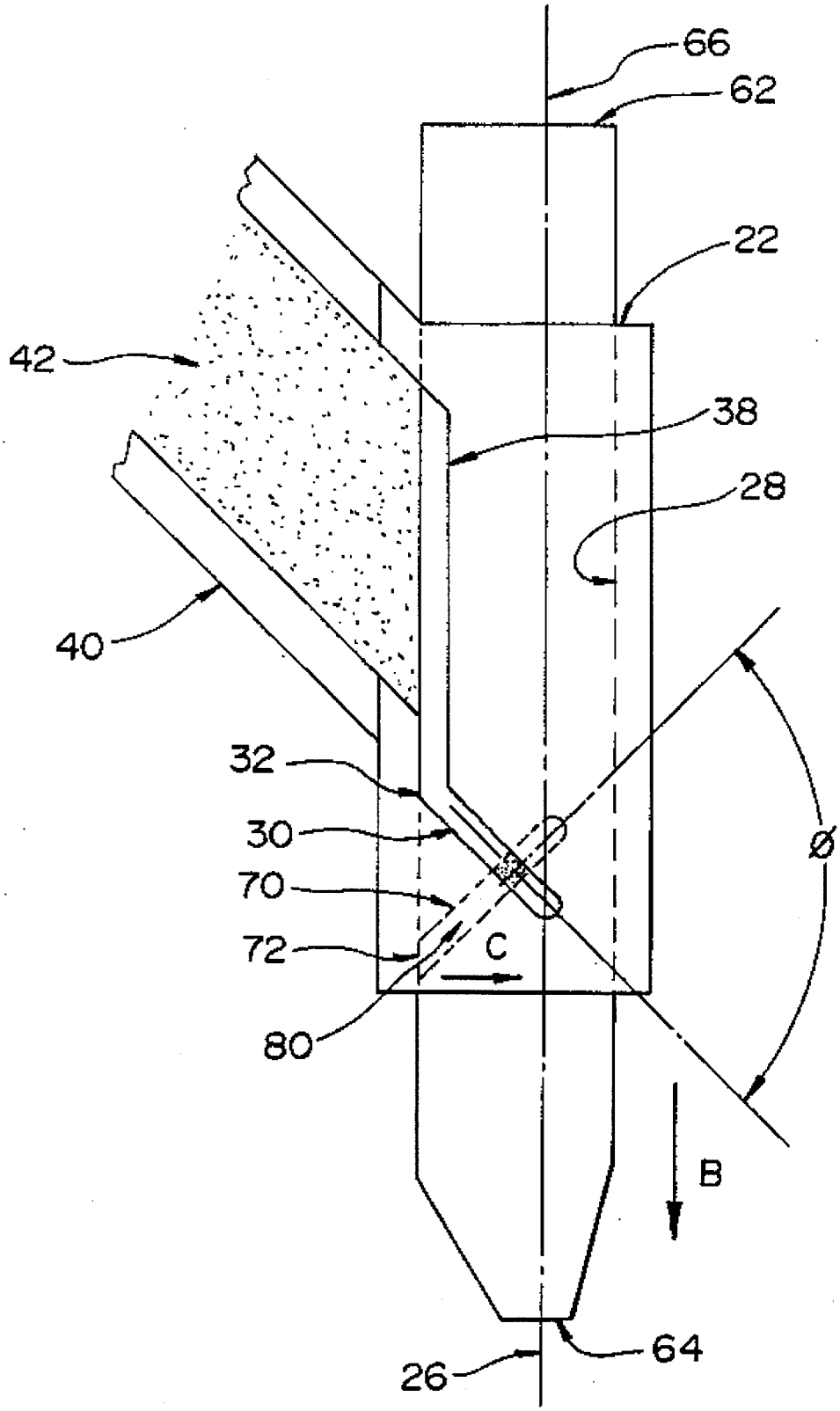

Referring to FIGS. 5 & 6, the engagement of the centerpiece 60 and the housing 20 is illustrated. The centerpiece 60 is inserted into the housing bore 28 and oriented so that the centerpiece slot proximal end 72 is adjacent to the stock box 40. In the operation of the present invention, the centerpiece 60 is displaced in the housing bore 28 from the housing first end 22 toward the housing second end 24 (the displacement direction of centerpiece 60 is indicated by arrow A). In accordance with the invention, displacement of the centerpiece 60 causes a plurality of brush bristles 42 from the area of the stock box 40 immediately adjacent to the housing opening 38 and the housing slot proximal end 32 to be gathered within a convergence of the housing slot 30 and the centerpiece slot 70 thereby gathering into a bristle bundle 80. In the vertically oriented embodiment illustrated, the convergence can be seen in side elevation view as an open region defined by the intersection of the housing slot 30 and the centerpiece slot 70, which region is open horizontally from the housing side elevation shown through to the opposite housing side (not shown), such that the bristle bundle 80 is disposed within the open region.

Further in accordance with the invention, in FIG. 6 the centerpiece 60 advances downward in the housing bore 28 as indicated by arrow B. The convergence moves toward the housing longitudinal axis 26 because of the movement of the intersection of the housing slot 30 and the centerpiece slot 70 resulting from the downward displacement of the centerpiece 60 in relation to the housing 20. The bristle bundle 80 gathered within the convergence of the housing slot 30 and the centerpiece slot 70 is thereby transported toward the housing longitudinal axis 26 as indicated by arrow C. Thus, following the preferred operation of the illustrated embodiment, the displacement of the centerpiece 60 within the housing bore 28 transports the bristle bundle 80 within the convergence of the respective slots 30 and 70 from the housing exterior toward the respective distal ends 34 and 74 of the slots. Further displacement of the centerpiece 60 in the direction of arrow B (not shown) transports the bristle bundle 80 within the convergence of the slots 30 and 70 such that slot distal ends 34 and 74 generally coincide horizontally and the bundle 80 is positioned approximately at the centerpiece longitudinal axis 66 in a tuft forming area. In the particular embodiment illustrated in FIG. 6, the angle ø defined by the extended centerlines of slots 30 and 70 is shown as approximately 90 degrees, however those skilled in the art will be able to determine this angle depending upon the many parameters particular to various brush filling operations, such as the displacement velocity of the centerpiece 60, the type and size of the bristles 42, the configuration of the centerpiece 60, and the configuration of the housing 20.

Figure 10:
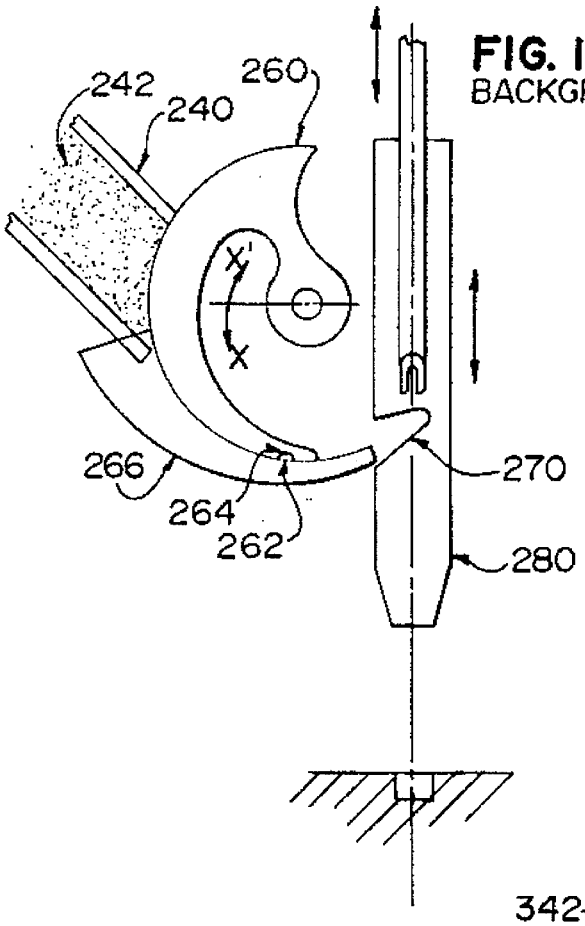
FIG. 10 BACKGROUND ART
FIG. 10 is a side elevation view of a conventional "sickle-type" oscillating picker bar.
Figure 11:
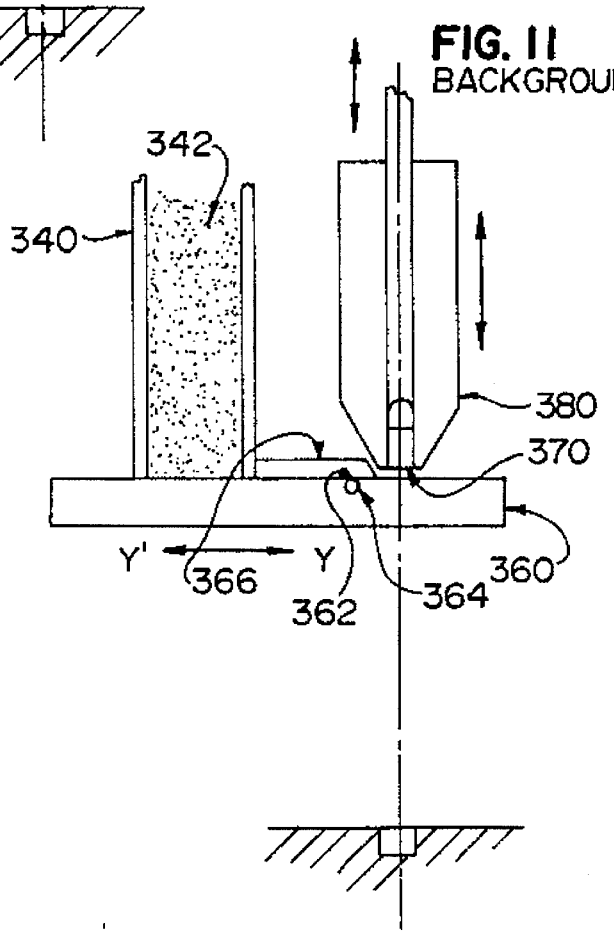
FIG. 11 BACKGROUND ART
FIG. 11 is a side elevation view of a conventional "flat-type" reciprocating picker bar.

Thus, in the present embodiment of the invention a bristle bundle is gathered from a stock box or magazine and transported to the tuft forming area of the filling tool without the need for a separate picker bar sub-assembly as used in the conventional apparatus of FIGS. 10 & 11. Referring to FIG. 10, a conventional bristle gathering apparatus is shown which has a stock box 240 containing a plurality of brush bristles 242. A sickle-type picker bar 260 has a notch 264 and a slide bar 266. A filling tool 280 has a tuft forming area 270. In operation, the picker bar 260 oscillates in the direction of arrow X, gathers a bristle bundle 262 in notch 264, transports the bundle along the slide bar 266, and positions the bundle 262 in the tuft forming area 270 of the filling tool 280. After the bundle 262 is removed from the notch 264 by other apparatus (not shown), the picker bar 260 then reverse oscillates in the direction of arrow X' and the operation is repeated.

Referring to FIG. 11, another conventional bristle gathering apparatus is shown which has a stock box 340 containing a plurality of brush bristles 342. A flat-type picker bar 360 has a notch 364 and a slide bar 366. A filling tool 380 has a tuft forming area 370. In operation, the picker bar 360 reciprocates in the direction of arrow Y, gathers a bristle bundle 362 in notch 364, transports the bundle along the slide bar 366, and positions the bundle 362 in the tuft forming area 370 of the filling tool 380. After the bundle 362 is removed from the notch 364 by other apparatus (not shown), the picker bar 360 then reverse reciprocates in the direction of arrow Y' and the operation is repeated. The conventional apparatus shown in FIGS. 10 & 11 require complicated precision drive mechanisms (not shown) to cause the picker bars to operate in a synchronous manner with the filling tool apparatus. The present invention eliminates the separate picker bar subassemblies of conventional filling tools shown in FIGS. 10 & 11 and eliminates the corresponding separate complicated picker bar precision drive mechanisms.

Further in accordance with the invention, in FIG. 1 a driving member 90 is shown disposed within the centerpiece bore 68. The driving member 90 has a first end 92 and a second end 94, and a longitudinal axis 96 extending generally from the first end 92 to the second end 94. The exterior dimensions and outline of the driving member 90 are generally the same as the dimensions and outline of the centerpiece bore 68. The machine tolerances and fit between the exterior of the driving member 90 and the centerpiece bore 68 will be known to those skilled in the art as would be required to allow the driving member 90 to reciprocate within the centerpiece bore 68 at a rate of up to 500 cycles per minute. In the embodiment shown in FIG. **2*b*, the cross-sectional outline of the centerpiece bore 68 adapted to receive the driving member 90 is shown as a rectangle with its centerline 69 and its long sides generally perpendicular to the convergence of slot distal ends 34 and 74. The corresponding rectangular cross-sectional outline of the driving member 90 is not shown in FIG. 2*b*. A view through the narrower width of the driving member 90 is shown in cross-sectional elevation view within the centerpiece bore 68 in FIG. 2*a***. Other cross-sections such as diamond-shaped, pentagonal, or round may be equally suitable to practice the present invention.

In accordance with a further aspect of the invention, in FIGS. **2*a* & 3 a fastener forming tool 100 is shown. The fastener forming tool 100 has a proximal end 101 pivotably attached to a fixed point 102 and a distal end 104 which has a fastener forming mandrel 106. In the vertically oriented embodiment illustrated, the cross-section of the mandrel 106 is formed as an inverted U-shape and can be seen in phantom sectional elevation in FIG. 1. The centerpiece 60 has an opening 76 adapted to receive the mandrel 106. The mandrel opening 76 extends from the exterior of the centerpiece 60 and intersects the centerpiece bore 68 near the centerpiece longitudinal axis 66. The region formed within the interior of the centerpiece 60 at the intersection of the mandrel opening 76 and the centerpiece bore 68 is a fastener forming area. In FIGS. 2*a* & 3, the mandrel opening 76 is shown in cross-sectional elevation view, and in FIG. 1 the mandrel opening 76 is shown in phantom sectional elevation and is also shown in FIG. 3 as mating openings 76' and 76"). The mandrel 106 is adapted to be received by the mandrel opening 76 so that mandrel 106 is positioned in the fastener forming area approximately at the centerpiece longitudinal centerline 66**.

The fastener forming tool 100 has a cam surface 108 adjacent to the exterior of the centerpiece 60. The exterior of the centerpiece 60 has a mating surface 110 adjacent to the cam surface 108. In the embodiment illustrated in FIGS. 2*a* & 3, the mating surface 110 is shown recessed into the interior of the centerpiece 60, but those skilled in the art will appreciate that other configurations of the cam surface 108 the mating surface 110 could be employed to practice the present invention. For example, the mating surface 110 could project out from the exterior of the centerpiece 60, or the cam surface 108 could be recessed into the interior of the forming tool 100.

The forming tool 100 has a spring means 112 for positively urging the cam surface 108 against the mating surface 110. In the illustrated embodiment, the spring means 112 are shown attached to the forming tool distal end 104. Other suitable means 112 may be used, for example, a torsional coil spring attached to the forming tool 100 at the fixed point 102, or a system adapted to urge the cam surface 108 against the mating surface 110 using pneumatic pressure, hydraulic pressure, or gravity.

Referring again to FIG. 2*a* & 3, in the operation of the illustrated apparatus of the present invention the centerpiece 60 is displaced with respect to the forming tool 100 from the tool proximal end 101 toward the tool distal end 104 in the direction of arrow E. The displacement of the centerpiece 60 causes the mating surface 110 to slide against and engage the cam surface 108. The configuration of the cam surface 108 causes the forming tool 100 to pivot about the fixed point 102 and away from the centerpiece 60 in the general direction of arrow F. The displacement of the forming tool 100 caused by pivoting in the direction of arrow F withdraws the mandrel 106 from the fastener forming area and from the mandrel opening 76 in the centerpiece 60. In reverse operation of the embodiment shown in FIGS. 2*a* & 3, the centerpiece 60 reciprocates and is displaced in the direction of arrow E'. The mating surface 110 slides against and continues to engage the cam surface 108. The spring means 112 positively urges the cam surface 108 against the mating surface 110 so that the configuration of the cam surface causes the forming tool 100 to pivot about the fixed point 102 in the general direction of arrow F'. The displacement of the forming tool 100 caused by pivoting in the direction of arrow F' inserts the mandrel 106 into the fastener forming area through the mandrel opening 76 in the centerpiece 60. In the preferred embodiment of the present invention, the dimensions of the mandrel opening 76 corresponding to the direction of the centerpiece 60 displacement are designed in order that the sliding engagement of the cam surface 108 and the mating surface 110 causes the mandrel 106 to completely withdraw from the mandrel opening 76 during displacement of the centerpiece 60 without contacting the centerpiece 60. In the embodiment illustrated in FIG. 1, the mandrel opening 76 is shown in phantom as a vertically oriented generally rectangular slot with its long sides parallel to centerpiece longitudinal axis 66. Those skilled in the art will appreciate that the mechanical relationship of the cam surface 108, mating surface 110, mandrel 106, and mandrel opening 76 are dependent upon the displacement velocity of the centerpiece 60 with respect to the forming tool 100 and can be determined using standard machinery component design methodology. Thus, the present invention allows the forming tool 100 to be received into and withdrawn from the fastener forming area in the centerpiece 60 by reciprocation of centerpiece 60 and without using the complicated precision drive mechanism of conventional fastener forming apparatus.

In keeping with another feature of the invention, a fastener stock feeding device 120/120' is shown in FIG. 1. In the illustrated embodiment, the feeding device 120/120' is shown with a first wheel 120 and an opposite second wheel 120' which cooperate to feed fastener stock 122 such as staple wire from a stock supply such as a spool or the like (not shown) into the housing 20. A die 124 is inserted in the exterior of housing 20 and occupies the thickness of the housing 20 between the housing exterior and the housing bore 28. The die 124 is shown in phantom elevation in FIG. 1. A stockhole (not shown) formed within the die 124 extends from the exterior of housing 20 to the housing bore 28. The stockhole is adapted to conduct the fastener stock 122 from the feeding device 120/120' into the housing bore 28. The centerpiece 60 has a fastener feed opening 78 (also shown in FIG. 3 as mating openings 78' and 78") formed in the interior of the centerpiece 60 which opens into the centerpiece bore 68 and intersects the mandrel opening 76 and the fastener forming area approximately at the centerpiece longitudinal axis 66. The fastener feed opening 78 is shown in phantom elevation in FIG. 1. Also shown in phantom in FIG. 1 is the fastener stock 122 inserted through the stockhole (not shown) in the die 124 so that the stock 122 is positioned in the fastener feed opening 78 in the fastener forming area above the mandrel 106. Rounded shoulders 77 are formed at the intersection of the fastener feed area 78 and the centerpiece bore 68. A cutting edge 79 is formed in the centerpiece 60 exterior at the top of the fastener feed opening 78 adjacent to the die 124 so that displacing the centerpiece 60 toward the housing second end 24 causes the cutting edge 79 to sever the fastener stock 122 inserted into the fastener feed opening 78 through the stockhole in the die 124 so that a fastener stock segment 126 remains positioned in the fastener forming area above the mandrel 106. Further displacement of the centerpiece 60 toward the housing second end 24 causes the shoulders 77 to contact the stock segment 126 and bend it over the mandrel 106.

Pursuant to a further feature of the invention, a filling tool drive mechanism 140 is shown in FIG. 1. The drive mechanism 140 is attached to a fixed member of the brush making machine (not shown). The drive mechanism 144 includes a shaft 144 supported in a bearing 142. The shaft 144 is connected to a motor (not shown) which rotates the shaft at angular velocity ω. A crank 146 having a proximal end 147, an intermediate point 148, and a distal end 150 is connected to the shaft 144. The crank intermediate point 148 is positioned at diameter d' from the centerline of the shaft 144 and the crank distal end 150 is positioned at diameter d" from the centerline of the shaft 144. Centerpiece linkage 160 connects the crank intermediate point 148 to the centerpiece 60 and driving linkage 170 connects the crank distal end 150 to the driving member 90.

Referring again to FIG. 1, in operation of the filling tool drive mechanism 140 according to the present invention, rotating the shaft 144 at angular velocity ω causes the crank intermediate point 148 and the crank distal end 150 to rotate at angular velocities ω' and ω", respectively. Rotating the crank intermediate point 148 at angular velocity ω' causes the centerpiece linkage 160 to displace the centerpiece 60 at linear velocity V'. Rotating the crank distal end 150 at angular velocity ω" causes the driving linkage 170 to displace the driving member 90 at linear velocity V". Because diameter d" is greater than diameter d' the driving member linear velocity V" is generally greater than the centerpiece linear velocity V'. Those skilled in the art will appreciate how to design the connections between the crank 146 and the linkages 160 and 170 so that the crank intermediate point angular velocity ω' is translated into the proper centerpiece linear velocity V' and the crank distal end angular velocity ω" is translated into the proper driving member linear velocity V". In the present invention the filling tool drive mechanism 140 simultaneously operates the centerpiece 60, the driving member 90, and the fastener forming tool 100 (by cooperation of the cam surface 108, mating surface 110, and spring means 112) and thus eliminates the separate complicated precision drive mechanisms necessary to cause the various sub-assemblies of the conventional brush filling tool apparatus to operate in a synchronous manner.

Figure 7:
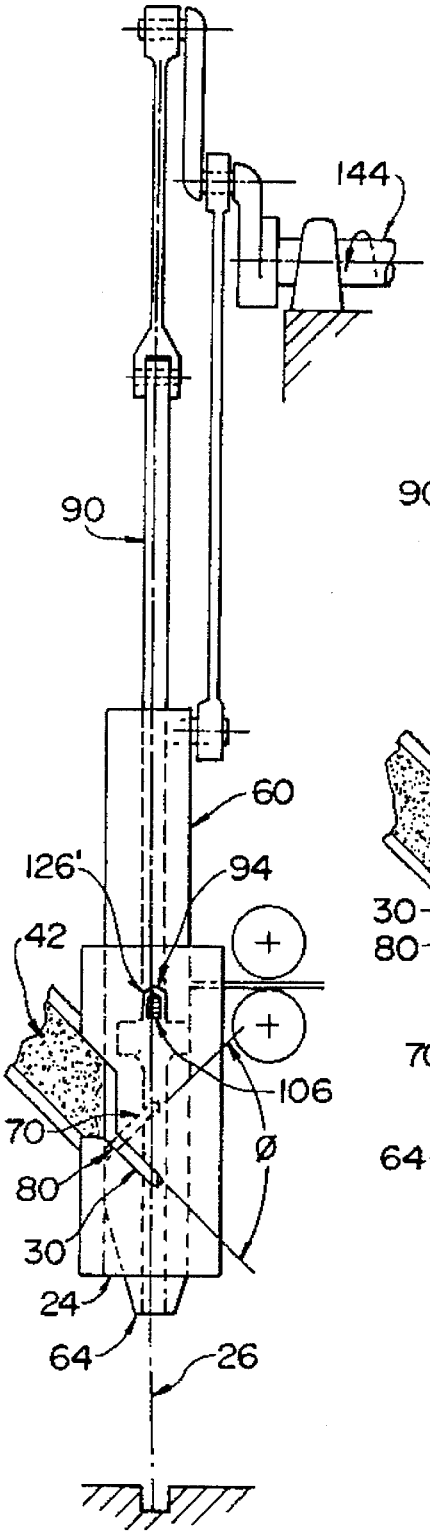
FIGS. 7–9 are side elevation views similar to FIG. 1 showing the sequence of operation of the apparatus according to the present invention.
Figure 8:
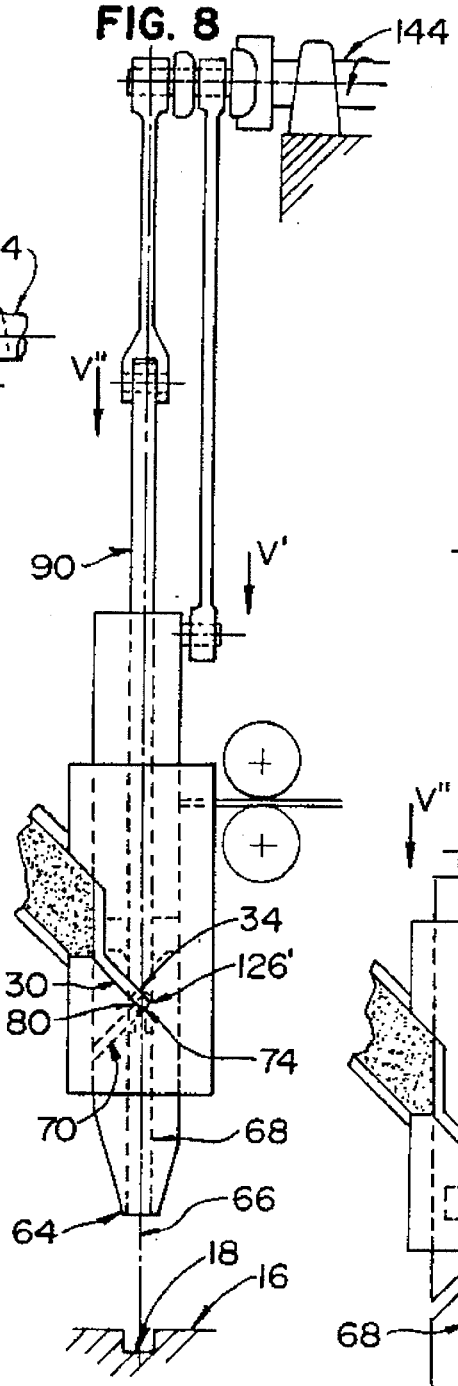
Figure 9:
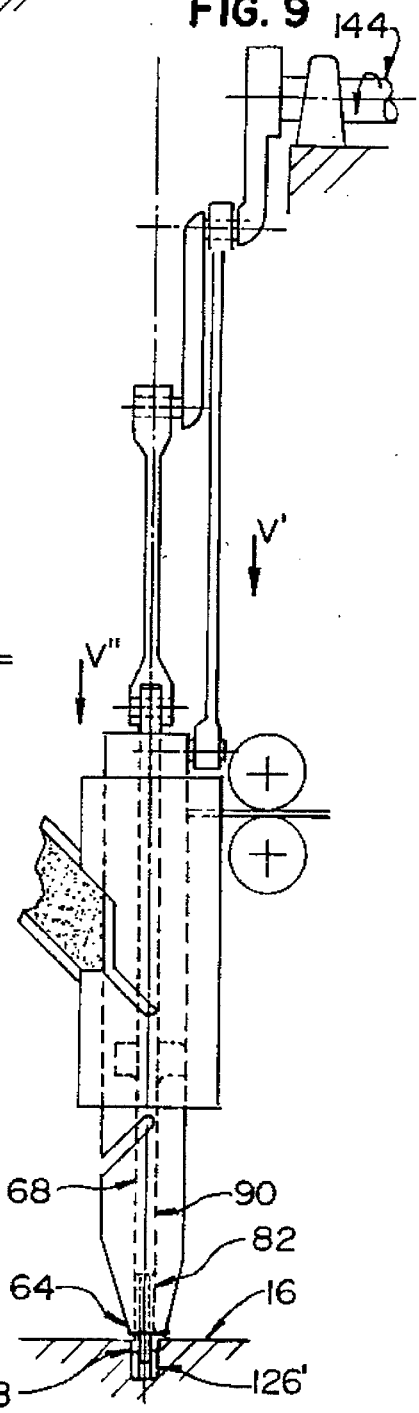

Referring now to FIGS. 7, 8, & 9, the continuous integrated operation of the filling tool according to the present invention is illustrated. In FIG. 7, the shaft 144 rotates at angular velocity ω thereby simultaneously causing the centerpiece 60 to be displaced within the housing bore 28 toward the housing second end 24 and the driving member 90 to be displaced within the centerpiece bore 68 toward the centerpiece second end 64. A bristle bundle 80 is gathered within the convergence of the housing slot 30 and the centerpiece slot 70 as explained above and detailed in FIGS. 5 & 6. The fastener forming area shoulders 77 (not shown; refer to FIG. 3) engage the fastener stock segment 126 (not shown) positioned in the fastener forming area above the mandrel 106 and bend the stock segment 126 over the mandrel 106 to form an inverted U-shaped fastener 126'. As the centerpiece 60 advances toward the housing second end 24, the sliding engagement of the cam surface 108 and the mating surface 110 (not shown; refer to FIG. 2*a*) causes the mandrel 106 to withdraw from the mandrel opening 76 (not shown; refer to FIG. 3). The driving member second end 94 then engages the fastener 126'.

Continuing to FIG. 8, the shaft 144 further rotates and continues to simultaneously cause the centerpiece 60 to be displaced within the housing bore 28 and out of the housing second end 24 and the driving member 90 to be displaced within the centerpiece bore 68 toward the centerpiece second end 64. The bristle bundle 80 gathered within the convergence of the housing slot 30 and centerpiece slot 70 is transported within the convergence of the slots 30 and 70 until the slot distal ends 34 and 74 generally coincide horizontally and the bundle 80 is positioned approximately at the centerpiece longitudinal axis 66 in the tuft forming area in the centerpiece bore 68 as explained above and detailed in FIGS. 5 & 6. The driving member second end 94 (not shown) advances the fastener 126' within the centerpiece bore 68 and positions the inverted U-shaped fastener 126' around the bristle bundle 80 at the approximate mid-point of the bundle 80 in the tuft forming area of the centerpiece bore 68.

In the vertically oriented embodiment shown in FIG. 8, the shaft 144 further rotates and continues to simultaneously cause the centerpiece 60 to be displaced within the housing bore 28 and out of the housing second end 24 and the driving member 90 to be displaced within the centerpiece bore 68 toward the centerpiece second end 64. The centerpiece longitudinal axis 66 is shown positioned generally above a hole 18 in a brush block workpiece 16. The driving member second end 94 simultaneously advances the fastener 126' and the bristle bundle 80 downward within the centerpiece bore 68 and the grooves 98. This displacement of the fastener 126' and bundle 80 within the centerpiece bore 68 foldingly transports (folds) the bristle bundle 80 from its horizontal position in the convergence of slots 30 and 70 into a vertical position within the grooves 98 of the centerpiece bore 68 thereby forming a bristle tuft 82 (tuft not shown in FIG. 8; refer to FIG. 9 and description below). The tuft 82 is folded by the downward displacement of the driving member second end 94 which forces the fastener 126' around the mid-point of the bristle bundle 80 while simultaneously forcing the mid-point of the bundle 80 within the centerpiece bore 68 further downward toward the centerpiece second end 64. Folding (also called "bending" or "breaking") the bristle bundle 80 at its mid-point causes the two end portions ("legs") of the bundle 80 extending upwardly within the grooves 98 in an upright U-shape to form the tuft 82. The fastener 126' and the tuft 82 occupy the space defined by the centerpiece bore 68 and the grooves 98 in the manner of the ends of opposing U-shaped half chain links.

Referring next to FIG. 9, the shaft 144 further rotates and continues to simultaneously cause the centerpiece 60 to be displaced within the housing bore 28 and out of the housing second end 24 and the driving member 90 to be displaced within the centerpiece bore 68 toward the centerpiece second end 64. Because the driving member linear velocity V" is generally greater than the centerpiece linear velocity V', the driving member 90 advances the fastener 126'/tuft 82 combination within the centerpiece bore 68 so that the combination arrives at the centerpiece second end 64 approximately contemporaneously with the arrival of the centerpiece second end 64 at the brush block workpiece 16. In the vertically oriented embodiment illustrated in FIG. 9, at the downwardmost displacement of both the driving member 90 and the centerpiece 60, the driving member second end 94 expels the fastener 126'/tuft 82 combination from the centerpiece bore 68 thereby anchoring the fastener/tuft combination into an adjacent brush block workpiece 16. The driving member second end 94 may project out of the centerpiece second end 64 as required to allow insertion of the fastener 126'/tuft 82 combination into a hole 18. Those skilled in the art will appreciate that other embodiments of the present invention also may be practiced to gather and form a bristle tuft 82 without including a U-shaped fastener 126' as described herein.

After the fastener 126'/tuft 82 combination is anchored to the brush block 16, the shaft 144 continues to turn (not shown in FIG. 9) thereby retracting the driving member 90 and the centerpiece 60 vertically and upwardly away from the workpiece 16. After one full revolution of the shaft 144, the driving member 90 and the centerpiece 60 are each disposed at their upwardmost displacement, and the filling tool apparatus appears as shown in FIG. 1 and is ready to repeat the complete cycle of operation as described above.

It will be seen that the invention described above overcomes several drawbacks associated with conventional filling tool apparatus. For example, the present invention provides an improved brush bristle gathering and tuft forming apparatus which includes fewer and less complicated sub-assemblies for gathering a bundle and forming a tuft of brush bristles. Also, the present invention eliminates the separate picker bar sub-assembly required to gather a bundle of brush bristles from a stock box or magazine and transport the bundle to the tuft forming area of the filling tool.

In addition, the invention described above improves the method of gathering a bundle of brush bristles and forming a tuft by utilizing fewer separate steps than the conventional brush bundle gathering and tuft forming method. Further, the present invention simultaneously performs the continuous integrated steps of gathering a bundle of brush bristles from a stock box or magazine and transporting the bundle to the tuft forming area, forming and positioning a fastener around the bristles, forming the tuft, and anchoring the fastener/tuft combination to the brush block workpiece without separate reciprocation of the various subassemblies of conventional filling tool apparatus.

A preferred embodiment of the present invention is described herein. It is to be understood, of course, that changes and modifications may be made in the embodiment without departing from the true scope and spirit of the present invention as defined by the appended claims.

What is claimed is:

1. An apparatus for gathering a plurality of brush bristles into a bundle, the apparatus comprising:

(a) a housing comprising:

(i) a first end, a second end, and a longitudinal axis extending generally from said first end to said second end;

(ii) a bore formed in the interior of said housing and extending generally along said housing longitudinal axis;

(iii) a slot formed in the exterior of said housing, said slot in communication with said housing exterior and having a proximal end and a distal end, said slot extending generally diagonally toward said housing second end into said housing interior such that said housing slot communicates with said housing bore; and (b) a centerpiece slidably received within said housing bore, said centerpiece comprising:

(i) a first end, a second end, and a longitudinal axis extending generally from said first end to said second end; and (ii) a slot formed in the exterior of said centerpiece, said centerpiece slot in communication with said centerpiece exterior and having a proximal end and a distal end that intersects said centerpiece longitudinal axis, said centerpiece slot extending generally diagonally away from said centerpiece second end toward said centerpiece longitudinal axis;

whereby displacing said centerpiece within said housing bore from said housing first end toward said housing second end gathers a plurality of brush bristles disposed at said housing slot proximal end into a bristle bundle within a convergence of said housing slot and said centerpiece slot and transports said bristle bundle within said convergence along said slots toward said centerpiece longitudinal axis.

2. The apparatus of claim 1 wherein said centerpiece further comprises a centerpiece bore formed in the interior of said centerpiece and extending generally along said centerpiece longitudinal axis.

3. The apparatus of claim 2 wherein said centerpiece further comprises a mandrel opening formed in said centerpiece exterior in communication with said centerpiece bore for receiving a fastener forming mandrel.

4. The apparatus of claim 2 further comprising a driving member slidably received within said centerpiece bore, said driving member comprising a first end, a second end, and a longitudinal axis extending from the first end to the second end, whereby displacing said driving member within said centerpiece bore from said centerpiece first end toward said centerpiece second end causes said driving member second end to engage said bristle bundle gathered within said convergence of said housing slot and said centerpiece slot, to foldingly transport said bristle bundle into said centerpiece bore thereby forming a tuft of bristles, to transport said tuft through said centerpiece bore to said centerpiece second end, and to anchor said tuft to an adjacent brush block workpiece.

5. The apparatus of claim 4 wherein said housing further comprises an opening in said housing exterior in communication with said housing slot proximal end for receiving said plurality of brush bristles disposed generally perpendicular with respect to said housing longitudinal axis.

6. The apparatus of claim 2 further comprising a fastener forming tool, said tool comprising:

(a) a proximal end adapted to pivot about a fixed point and a distal end having a fastener forming mandrel adapted to be received by said centerpiece mandrel opening so that said mandrel is positioned in a fastener forming area of said centerpiece; and (b) a cam surface operatively engaged with a mating surface of said centerpiece;

whereby displacing said centerpiece from said tool proximal end toward said tool distal end causes said cam surface and said mating surface to slidably engage thereby pivoting said tool about said fixed point such that said mandrel is withdrawn from said centerpiece opening.

7. The apparatus of claim 6 further comprising means for positively urging said cam surface against said mating surface, whereby displacing said centerpiece from said tool distal end toward said tool proximal end causes said cam surface and said mating surface to slidably engage, thereby pivoting said tool about said fixed point such that said mandrel is received into said centerpiece opening.

* * * * *